United States Patent [19]

Peterson et al.

[11] 4,145,966

[45] Mar. 27, 1979

[54] PORTABLE LABEL PRINTER

[75] Inventors: Gerald H. Peterson; William P. Davis, both of Salt Lake City, Utah

[73] Assignee: Bio-Logics Products, Inc., Salt Lake City, Utah

[21] Appl. No.: 627,513

[22] Filed: Oct. 31, 1975

Related U.S. Application Data

[63] Continuation-in-part of Ser. No. 469,418, May 13, 1974, abandoned, which is a continuation of Ser. No. 318,374, Dec. 26, 1972, abandoned.

[51] Int. Cl.[2] ..... B41F 3/20

[52] U.S. Cl. ..... 101/260; 101/228; 206/387; 226/68; 242/71.1; 271/84; 352/78 R; 360/132

[58] Field of Search ..... 242/55, 53, 55.2, 71.1, 242/71.2; 360/132; 206/387; 197/6.4, 6.5, 6.6, 6.7, 157, 168; 101/260, 228, 252, 272, 269, 288, 291, 292; 352/72, 78; 226/52, 62, 68; 271/84

[56] References Cited

U.S. PATENT DOCUMENTS

| | | | |
|---|---|---|---|
| 1,750,357 | 3/1930 | Ramdor | 101/247 X |
| 1,887,555 | 11/1932 | Johnson | 101/336 X |
| 3,119,328 | 1/1964 | Pittman et al. | 101/316 X |
| 3,127,989 | 4/1964 | Travaglio | 197/6.7 X |
| 3,129,813 | 4/1964 | Norvelle | 197/6.7 X |
| 3,203,348 | 8/1965 | Ellis | 101/272 |
| 3,277,992 | 10/1966 | Bremer | 197/6.7 |
| 3,311,209 | 3/1967 | Pedersen | 197/6.7 |
| 3,330,207 | 7/1967 | DeMan | 101/90 X |
| 3,349,883 | 10/1967 | Pedersen | 197/6.7 |
| 3,373,682 | 3/1968 | Angel | 101/260 |
| 3,408,929 | 11/1968 | Drillick | 101/269 |
| 3,572,241 | 3/1971 | Waterman | 101/272 |
| 3,702,726 | 11/1972 | Takeichi et al. | 352/72 |

*Primary Examiner*—Clyde I. Coughenour
*Attorney, Agent, or Firm*—B. Deon Criddle

[57] ABSTRACT

A portable hand held and manually operated label printer and a method of its use in transferring information from a master plate onto a pressure sensitive label. The printer consists of a magazine section wherein a continuous roll of serially linked pressure sensitive labels are installed with the roll end thereof threaded through an appropriate passage into a manually operated label receiving and printing group. A printing roller arranged on a spring biased slide within the label receiving and printing group, is manually displaced to travel over one of the pressure sensitive labels, sandwiching it against a master plate, transferring raised characters formed on the master plate into the label. A follower arrangement is included with the slide having a hook formed on an end thereof that aligns with and travels into one of a number of strategically placed holes spaced at intervals in the roll of labels to pull the serially connected labels therewith as the slide is biased back to its starting attitude, thereby dispensing a printed label from the printer end.

7 Claims, 8 Drawing Figures

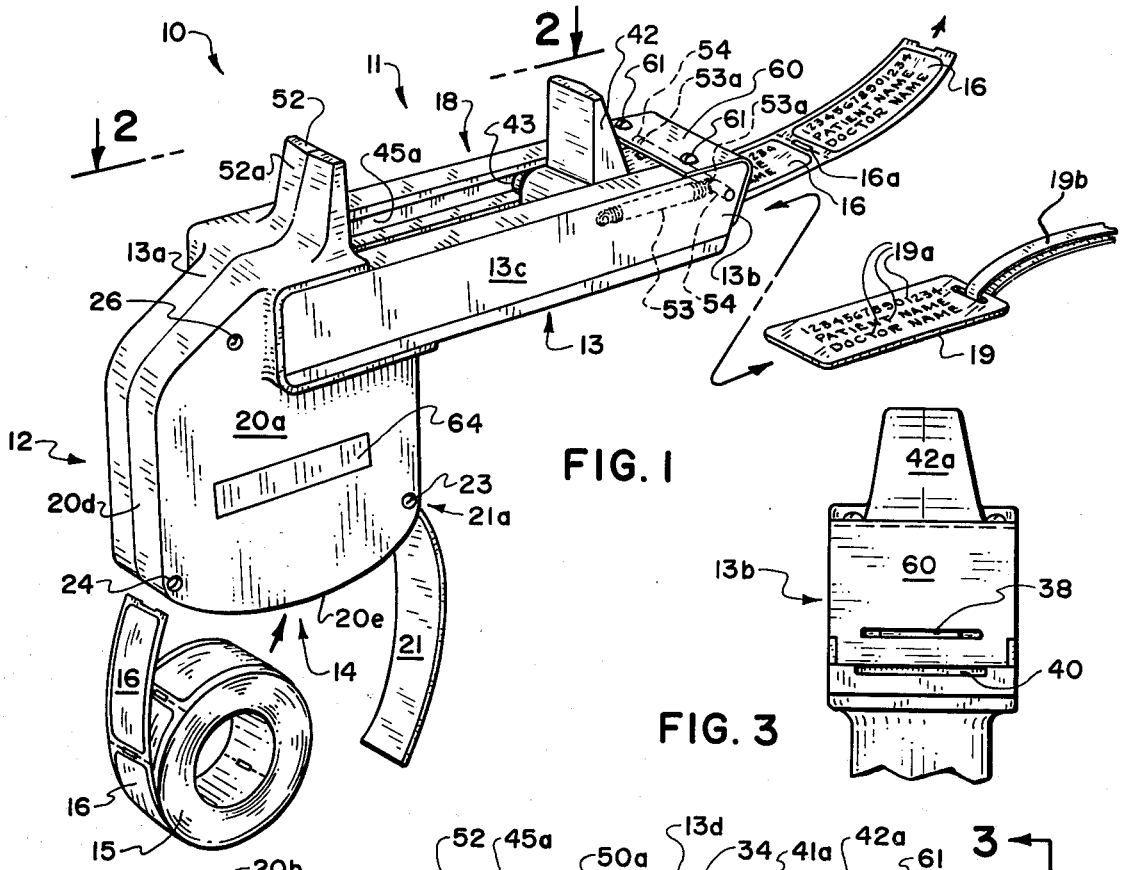
FIG. 1
FIG. 3
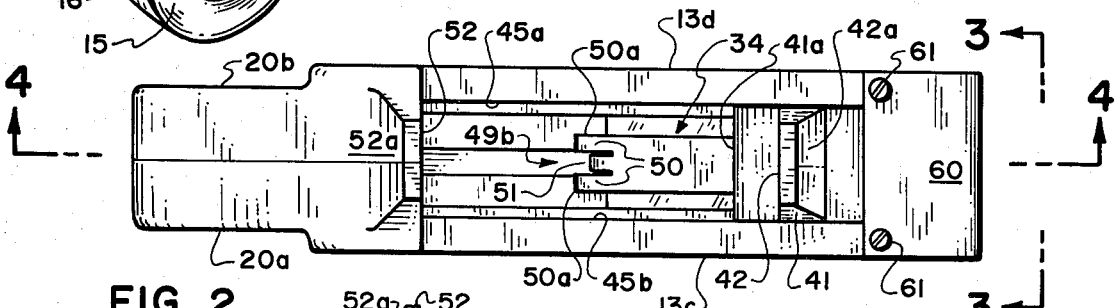
FIG. 2
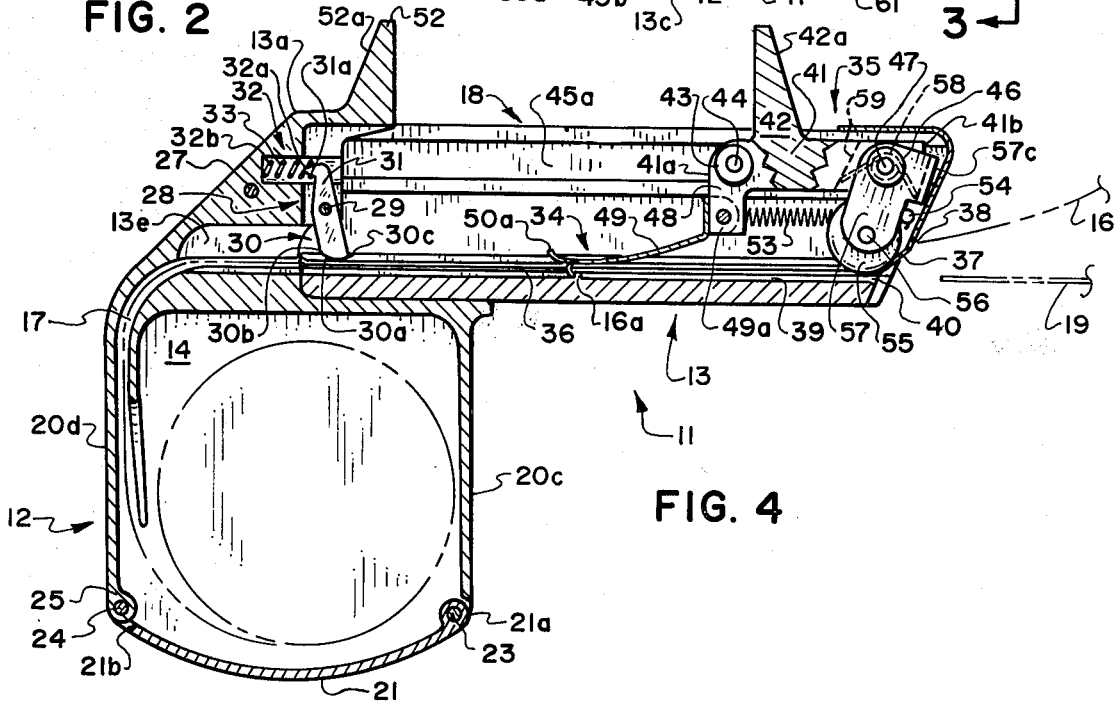
FIG. 4

PORTABLE LABEL PRINTER

This application is a continuation-in-part of application Ser. No. 469,418, filed May 13, 1974, now abandoned, which application was a continuation of application Ser. No. 318,374 filed Dec. 26, 1972 now abandoned.

BRIEF DESCRIPTION OF THE INVENTION

1. Field of the Invention

This invention relates to portable, hand held and manually operated printers suitable for transferring information formed on a master plate into a label.

2. Prior Art

The proper and accurate transfer of information, though important in most phases and activities of our society, is perhaps most critical in patient testing and care activities related to a hospital. Yet, with the increasing complexity and growth experienced by hospitals and related facilities, it has become increasingly difficult to be sure that a patients specimens, samples, test data, or the like, are properly identified when taken. Absent such a proper identification the test findings and conclusions and the treatment prescribed therefrom may be inaccurate, incorrect, or inapplicable to the patient in question, resulting in perhaps potentially ineffective and even lethal treatment being administered to a patient.

A number of devices and systems such as those shown in U.S. Pat. Nos. 3,660,916, 3,645,023, and 3,656,687, have been disclosed wherewith a patient, upon entering the hospital, is assigned an identification number or code. The assigned code is reproduced, from a master device that the patient wears, onto vessels, holders, identification cards and the like which are intended to receive and/or travel with various samples or test data related to the patient. While apparatus and systems like those disclosed in the aforesaid patents have been used successfully to properly and accurately mark a patient's samples and the like, an additional marking capability is sometimes desirable. Conceivably, it might be necessary to identify the glass a patient uses, the clothes he wears, vessels containing samples taken periodically, or the like. Essentially then, what is required and has to my knowledge not heretofore been available, is a simple, inexpensive, device that will immediately and accurately make up a label identifying the patient, which label can be secured to any object to identify that object with respect to the particular patient. The present invention is intended to provide just such a simple, efficient, and accurate device for printing one or any number of identifying labels from a single master plate that can be worn or carried by a patient.

SUMMARY OF THE INVENTION

It is a principal object of the present invention to provide a simple manually operated printing device capable of reproducing data from a master plate onto one or a number of labels.

Another object is to provide a label printing device that is hand held and manually operated to transfer information formed as raised characters on a master plate inserted therein onto one or a number of labels.

Another object is to provide a label printing device having a displaceable roller as the printing means therefore, which roller is arranged to be manually movable within the printing device so as to travel over a pressure sensitive label sandwiched between the roller and a master plate, such that the raised characters on the master plate are pressed into the label surface, discoloring to label at the point of identification, to form a permanent representation of the raised data thereon.

Still another object is to provide a label printing device capable of continuously feeding individual labels arranged as a roll of serially linked labels therethrough such that a printed label is dispensed from the label printing device with each passage of the roller over the master plate.

Still another object is to provide a label printing device having a minimum of moving parts which label printer is simple to construct from inexpensive materials.

Other objects are to provide a hand held, label printing device wherein replaceable magazine cassettes of blank labels can be snapped thereon to facilitate loading of the device and to provide for sequential numbering of of the labels.

Principal features of the present invention include a housing that is preferably shaped somewhat like a pistol with the butt end thereof arranged to be held in an operator's hand. The housing butt end is arranged as a label printer magazine section containing a continuous roll of gum backed, pre-cut, pressure sensitive labels serially linked together on a continuous backing sheet. A hinged door is provided across an opening formed along the edge of the housing butt end, through which opening the roll of labels is inserted into the label magazine section. The hinged door, when closed, frictionally engages the housing sides, to retain the roll of labels within the printer. The free end of the roll of labels is fed through an appropriate passage that leads from the label magazine section to a label receiving and printing group arranged in the barrel portions of the pistol shaped housing.

A slide is arranged within the receiving and printing group to travel longitudinally within the housing barrel section, moving a roller assembly therewith. The roller assembly when displaced with the slide towards the butt end portion of the housing, travels over a single pressure sensitive label in the roll of serially linked labels applying a continuous pressure on the top surface thereof. Each label, as it travels through the printer group, is in turn sandwiched against a master plate arranged within a master plate cavity formed within the printer housing, over which master plate the roller assembly is arranged to travel, applying a constant surface pressure on the individual sandwiched label. The master plate has information arranged thereon in the form of raised characters, such as a patient's name, doctor, or the like, which characters are pressed into the label backing surface as the roller assembly travels thereover.

The ends of coil springs are arranged to connect the opposite sides of the slide to the housing barrel end to return the roller assembly secured thereon back to a starting attitude proximate to the forward part of the housing near the barrel end thereof, after the force displacing the roller assembly over the master plate has been removed.

A torsion spring is arranged with the roller assembly to bias a roller portion thereof such that a pinching action is established between roller and master plate to hold the roller in position during transfer. The torsion spring biasing is overcome by the slide movement during the return movement of the roller assembly, urging the roller to swing upwardly. When the roller assembly is returned to its starting attitude, the roller hits a restraining post at the end of the stroke to cam the roller away from the master plate cavity such that the master plate can easily be installed or removed therefrom.

A stationary finger is formed to extend outwardly from the housing, extending from the junction of the housing barrel section with the housing butt end. A second finger, aligned directly opposite to the stationary finger, is secured to the movable slide extending outwardly therefrom so as to be parallel to, and on line, with the stationary finger. The first or stationary finger is intended as a thumb rest against which an operator, holding the butt end of the printer with his other hand, braces his thumb and extends his forefinger to contact the appropriate face of the slide mounted finger. The operator, by moving his forefinger and thumb together, then moves the movable finger and slide into proximity with the stationary finger, causing the roller assembly connected thereto to travel over the pressure sensitive label and master plate as has been described.

A follower arrangement is also secured to the slide to be displaced therewith, traveling above the serially linked labels positioned within the printer receiving and printing group. A follower arm of the follower arrangement has a hook formed in the unconnected end thereof, which hook is intended to pass into one of a number of appropriately placed holes that are spaced at equal intervals between the serially linked labels. The follower hook is arranged to drop into a label hole at the end of the printing stroke such that the linked labels will be drawn therewith when the spring biasing returns the slide back to its original position. The slide movement draws the follower arm hook such that the serially linked labels are pulled therewith dispensing a printed label from the end of the housing barrel section, when the slide is returned to its starting attitude, positioning the following label for the next printing cycle.

Roller pressure on the individual pressure sensitive label presses the raised characters on the master plate into the label backing and undersurface, which label undersurface discolors at the point of indentation and through the label thereby providing a permanent transfer of information from the master plate into the individual label.

Movement of the roller arrangement over an individual label tends, of course, to urge the individual label to move ahead of the printing roller, which movement tends to push the serially linked label against the desired direction of label movement. To prevent such label counter movement, parallel pivoting feet are provided that are spring biased to engage the label top surface along the labels opposite edges, binding thereagainst should an attempt be made to force the linked labels thereunder.

In other embodiments of the invention the magazine at the butt end of the housing may be made as an easily attached and removable cassette such that the preloaded cassette can be quickly and easily snapped in place. In addition an automatic numbering system may be used to sequentially number each label that is produced.

Additional objects and features of the invention will become apparent from the following detailed description, taken together with the accompanying drawings.

THE DRAWINGS

FIG. 1 is a perspective view of the label printer of the present invention showing a roll of labels being installed therein, a master plate for use therewith, and printed labels being dispensed from the end thereof;

FIG. 2, is a top plan view taken along the line 2—2 of the label printer of FIG. 1;

Figure 5:
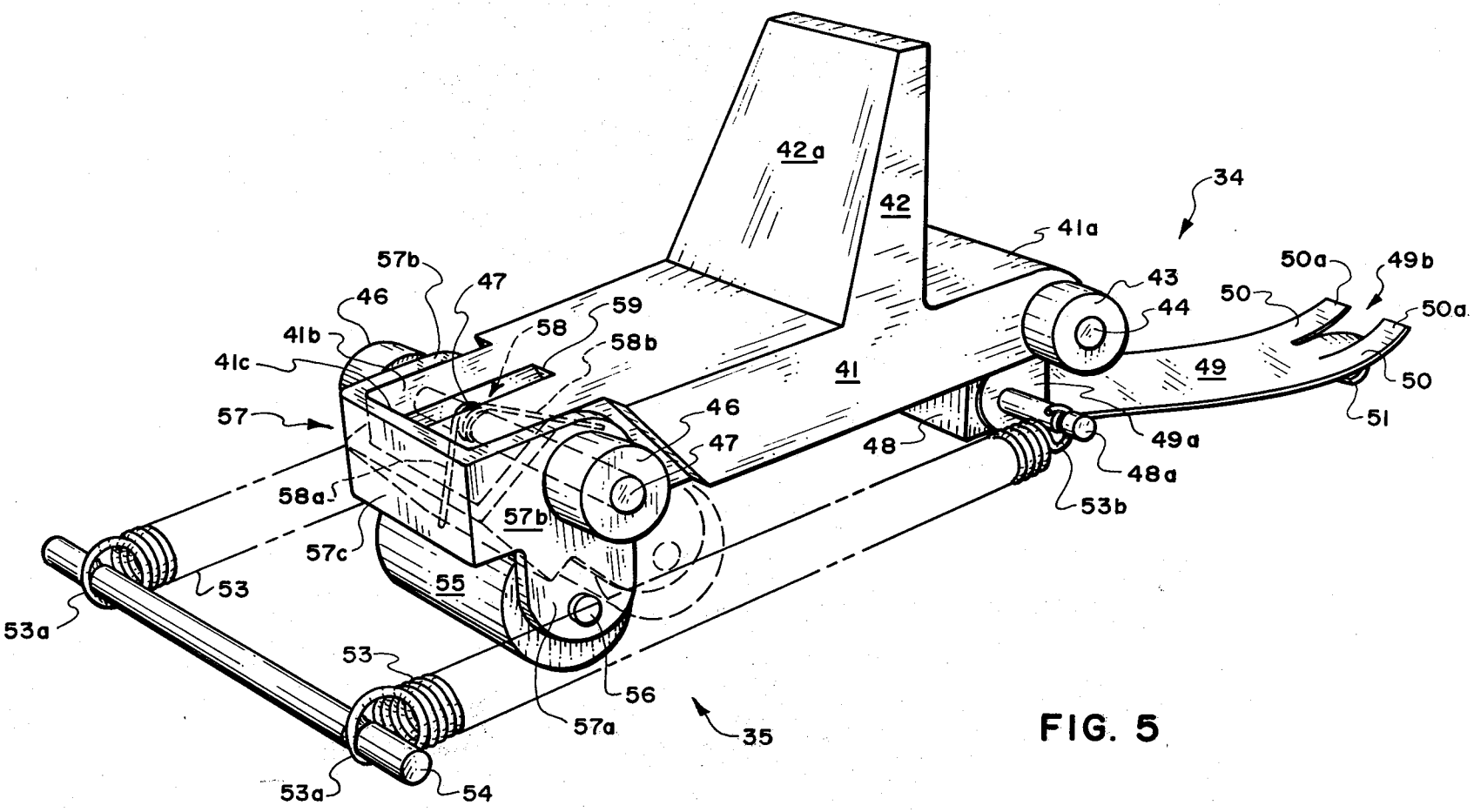
Figure 6:
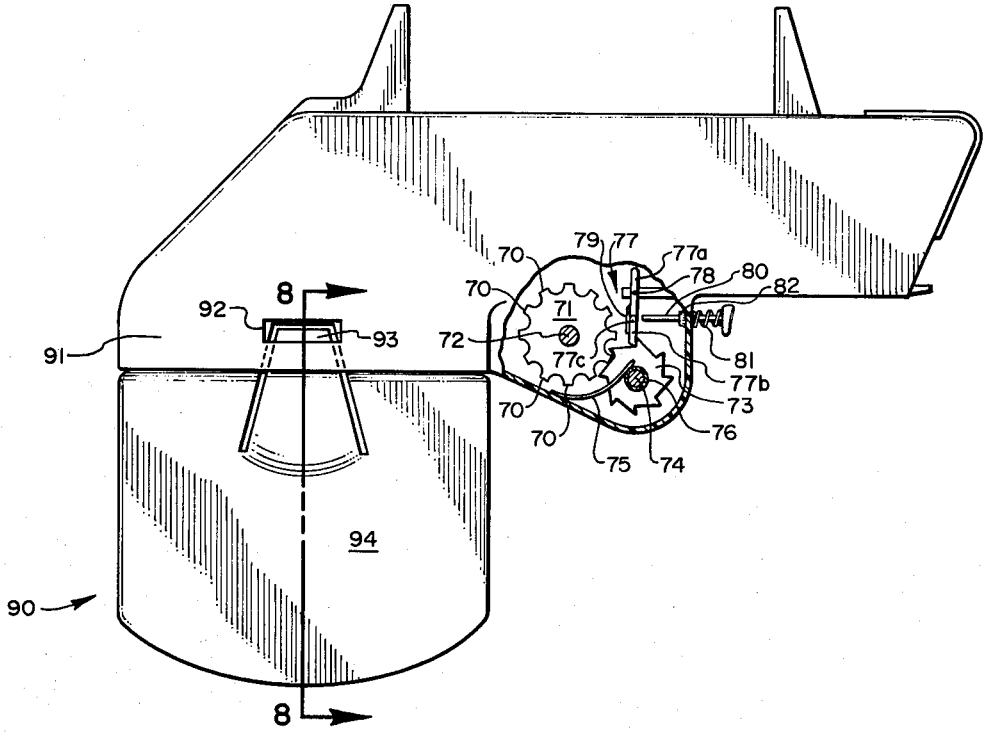
Figure 7:
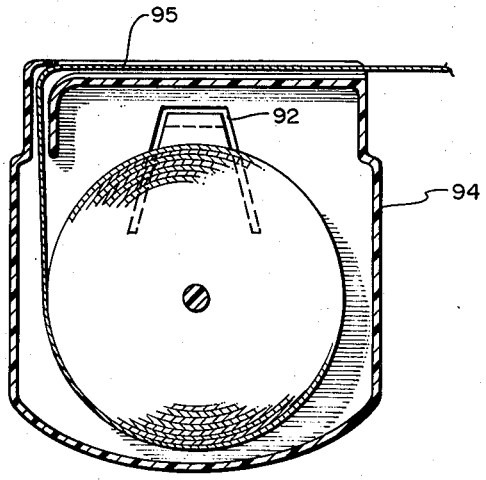

FIG. 3, a partial end view of the label printer of FIG. 2, taken along the line 3—3 of FIG. 2;

FIG. 4, a profile sectional view taken along the line 4—4 of FIG. 2;

FIG. 5, a profile perspective view of the slide of the present invention and spring biasing therefore shown removed from the housing barrel section;

FIG. 6, a side elevation view of a portable label printer of the invention equipped with a removable label cassette and an automatic numbering device;

FIG. 7, a sectional view of the removable label cassette; and

Figure 8:
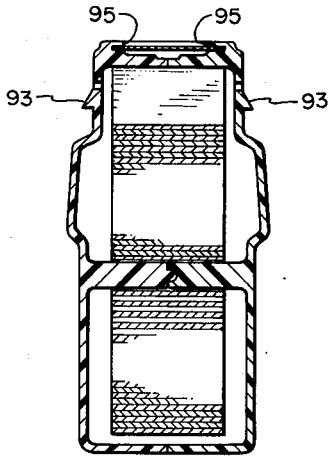

FIG. 8, a transverse vertical section through the removable label cassette, taken on the line 8—8 of FIG. 6.

DETAILED DESCRIPTION

Referring now to the drawings:

A portable label printer 10 of the present invention, hereinafter referred to as label printer, is shown in FIGS. 1 through 4, contained in a pistol shaped housing 11, hereinafter referred to as housing. The housing can be divided conveniently into a grip or butt end portion 12, intended to accommodate an operator's hand being closed therearound, and a barrel section 13, that is connected to and extends at a normal angle from the housing butt end portion. Shown best in the sectional view of FIG. 4, the housing butt end portion 12 contains a label magazine section 14 wherein a roll 15 of linked pressure sensitive labels 16 is contained. The labels are serially linked, and when unrolled from roll 15, travel through a passage 17 arranged in the housing 11 extending between the housing butt end portion 12 and barrel section 13. The passage 17 ends in a label printing section 18 that is arranged in the housing barrel section 13. Shown in FIG. 1, the label printer 10 is intended to utilize a master plate 19, transferring raised indicia **19*a* formed thereon, to one of the linked labels 16, which printing operations and the installation and removal of the master plate 19 in the label printer 10** will be explained in greater detail later herein.

The label magazine section 14 is formed as a cavity between right and left hand walls **20*a* and 20*b* and front and rear sides 20*c* and 20*d* of the housing butt end portion 12 to contain the roll of labels 15. Shown in FIG. 1, the roll of labels 15 can be inserted into the magazine section 14 by opening a door 21. The door 21 is arranged to close across an open bottom end 20*e* of the housing butt end portion 12 and is pivotally hinged on its one end 21*a* to the housing butt end portion front side 20*c*. A bolt 23 inserted through the right butt end portion wall 20*a*, the door and 21*a*, and through the opposite butt end portion walls 20*b* proximate to the edge thereof provides the pivotal coupling of the door 21 across the opening 20*e*. Additional to providing the pivotal coupling of the door 21 across the opening 20*e*, the bolt 23** also aids in maintaining the housing butt end portion walls against the butt end portion sides.

The door 21 is formed to just fit between the edges of the housing butt end portion walls **20*a* and 20*b*, providing a friction lock therebetween. The friction lock is intended to be sufficient to retain the weight of the roll of labels 15 thereagainst, but can be easily overcome by an operator inserting his fingernail or a like sharp edged object beneath the free end 21***b* of the door 21, FIG. 4, and prying thereagainst to pivot the door 21 to the attitude shown in FIG. 1.

A bolt 24, like the bolt 23 already discussed herein, is shown in FIG. 1, arranged in the right hand wall 20*a* of the housing butt end portion 12, to extend, as shown in FIG. 4, through an appropriate pier 25 formed on the lower edge of the housing butt end portion rear side 20*d*, and through the left hand wall 20*b* to couple together the housing butt end portion. The housing 11 is additionally maintained together by a bolt 26, FIG. 1, which is fitted through a hole 27, shown in FIG. 4, that is arranged through the rearmost end 13*a* of the housing barrel section 13.

As described, passage 17 is formed to provide a path of travel for the serially linked labels 16 from the label magazine section 14, into the label printing section 18. Shown in the sectional view of FIG. 4, the end of the serially linked labels 16, as it emerges from the passage 17, first encounters on opposite sides thereof feet 28. Feet 28 are each journaled onto the opposite ends of an axle 29 that is arranged across the end 13*a* of the housing barrel section 13 to swing so as to move shoe ends 30 thereof in arcs intersecting the path of travel of the opposite sides of the serially linked labels 16. The opposite ends 31 of each of the pivotally connected feet 28, one of which feet is shown in the sectional view in FIG. 4, each have a post 31*a* formed thereon extending in a plane approximately normal to the individual end 31, which post 31*a* is arranged to serve as a seat for the end 32*a* of a spiral spring 32 fitted thereover. The opposite end 32*b* of each of the spiral springs 32 is in turn contained within cavities 33 that are formed alongside and parallel to one another in the rear end portion 13*a* of the housing barrel section 13, and directly in line with the ends 31 of each of the feet 28. Spiral springs 32 are arranged to bias each of the individual ends 31 of feet 28 such that the opposite pivotally mounted shoe ends 30 are each urged into engagement with the surface of the linked labels 16. Each shoe 30 is provided with a slanted portion 30*a* that tapers downwardly from a rearmost edge 30*b* to a forward most edge 30*c* thereof. The slanted portion 30*a* of each foot 28 is formed to pass the serially linked labels 16 thereunder in a direction of travel from the magazine section 14 into the label printing section 18. Should, however, the direction of travel be reversed, with an attempt being made to pull or push the linked labels 16 from the printing section 18 back through the passage 17 into the magazine section 14, then the slanted portions 30*a* of the shoes 30 biased by the energy stored in the spiral springs 32 are cammed against the surface of the passing linked labels 16, preventing backward movement of the linked labels. The described binding engagement of the shoe forward edges 30*c* against the linked labels 16 is released by again moving the serially linked labels 16 forward from the magazine section 14. Movement of which linked labels 16, as will be explained in detail later herein, is accomplished by a manually driven follower arrangement 34 that is connected to a traveling printer roller group 35, whose function will also be explained later herein.

Shown also in the sectional view in FIG. 4, the linked labels passing by the feet 28 thereafter travel in parallel guide slots 36, one of which is shown in FIG. 4, that are formed to extend longitudinally along the opposite side walls of the housing barrel section 13, and end at the forward most end 13*b* of the housing barrel section 13. A label guide surface 37 is provided at the ends of the guide slots 36, formed as a lower portion of a front connector plate 60, which connector plate extends across, and is coupled by screws 61 to the forward end 13*b* of the housing barrel section 13. The serially linked labels 16 traveling forward between the guide slots 36 contact the label guide surface 37 and are guided thereby into and through a narrow label dispensing opening 38 formed as a slot across the housing section forward end 13*b* through the front connector plate 60.

Arranged longitudinally in between and below the guide slots 36, proximate to the housing barrel section forward end 13*b*, is a cavity 39, FIG. 4, that is arranged to receive the master plate 19 inserted therein. The master plate 19, shown in FIG. 1, is intended to be inserted into the described cavity 39 through an appropriate narrow opening 40 formed also as a slot that extends across and through the front connector plate 60, which slot opening 40 is arranged parallel to and immediately below the label dispensing slot opening 38.

The master plate 19, shown in FIG. 1, has certain groupings of indicia 19*a*, formed as raised numbers, letters, or the like thereon, whose arrangement is indicative of a specific patient and information concerning his condition, or the like. In practice, the master plate 19, which is preferably connected to a health care patient, not shown, by a tether 19*b*, is installed within the cavity 39 such that the raised indicia 19*a* are positioned directly below and in contact with the undersurface of the linked labels 16. Each of the individual serially linked labels 16 is formed of a pressure sensitive material which, when a sharp edged surface is pressed thereagainst or against the backing paper thereof, will be permanently discolored at the point of contact of the sharp edged surface. The backing used to connect the serially linked labels 16 must therefore be formed of an easily deformable material which will freely pass indentations made therein into the individual labels. Printing the raised indicia from the master plate 19 onto a serially linked label 16 is preferably accomplished by applying a constant roller pressure over the entire top surface of the individual label forcing the label backing against the raised indicia 19*a* on the master plate 19 therebelow.

Shown in the section view in FIG. 4, the follower arrangement 34 and the printer roller group 35 are secured to the opposite ends of a slide 41. The center area of which slide 41 has a finger 42 projecting outwardly therefrom. The slide 41 is supported on its rear end 41*a* by rear guide rollers 43, shown in FIGS. 4 and 5, journaled onto the opposite ends of an axle 44 that extends across the rearmost end 41*a* of the slide 41. Rear guide rollers 43 support the rear end 41*a* of the slide 41 between tracks 45*a* and 45*b*, FIG. 4, that are arranged longitudinally along the opposite inside surfaces of the respective opposite side walls 13*c* and 13*d* of the housing barrel section 13. Forward guide rollers 46 which support the forward slide end 41*b*, are journaled on the ends of an axle 47 that extends across the side forward end 41*b* between the tracks 45*a* and 45*b*.

Guide rollers 46, like guide rollers 43, travel in tracks 45*a* and 45*b* supporting the slide 41 as it travels longitudinally back and forth within the housing barrel section 13. Shown best in FIG. 5, a node 48 is formed to extend downwardly at a normal angle from the rear undersurface of the end 41*a* of the slide 41. Node 48 receives a pin 48*a* inserted laterally therethrough and receives bent ends 49*a* of a follower arm 49 of the follower arrangement 34 fitted thereover to loosely connect the follower arm 49 across the node 48. The free end 49*b* of the follower arm 49, opposite to the connection of ends 49*a* to the node 48, is split longitudinally along two spaced parallel lines tri-secting the follower end 49*b* into parallel outside fingers 50. The fingers 50 are upturned along the ends 50*a* thereof to facilitate the follower arm free end 49*b* in sliding over the serially linked labels 16 as the follower 49 passes thereover. The follower arm end 49*b* middle portion formed between the fingers 50 and is bent oppositely to the finger ends 50*a* into a hook 51.

Longitudinal movement of the slide 41 moves the follower arm 49 therewith such that the hook 51 passes over approximately the longitudinal middle of the serially linked labels 16. Shown in FIGS. 1 and 4, the serially linked labels 16 have holes 16*a* formed in space arrangement therein between the individual labels along the longitudinal middle thereof. Rearward longitudinal movement of the slide 41 between the tracks 45*a* and 45*b* moves the follower arm 49 such that the follower arm hook end 51 is first cammed out of a hole 16*a*, moving the hook rearwardly over a following label until the hook 51 is aligned with, and moves into, a following label hole 16*a*. As the slide 41 is returned to its original location, as will be explained later herein, the hook 51 pulls against the side of hole 16*a*, moving the serially linked labels 16 therewith unrolling the roll of labels 15.

Longitudinal movement of the slide 41 is manually accomplished by an operator, not shown, bracing his thumb, not shown, against a rearmost slanted face 52*a* of a stationary finger 52 that is formed to extend essentially perpendicularly upward from the rearmost portion 13*a* of the housing barrel section 13. The operator then places his index finger over the forward most edges 42*a* of the slide finger 42, and by closing his finger and thumb together, moves the slide finger 42 towards the stationary finger 52; thereby moving the slide 41 with the follower arm 49 preceding the slide. The follower arm end 49*b* travels over the serially linked labels, ahead of the slide 41, and passes between the pivoting feet 28 and into a cavity 13*e* formed between the junction of the housing butt end portion 12 and the barrel section 13 with rearward movement of slide 41 interrupted by the slide finger 42 contacting the stationary finger 52.

To return the slide 41 to its starting attitude, the operator merely releases the slide finger 42, whereupon spiral springs 53, FIGS. 1 and 5, arranged along opposite sides of the housing barrel section 13, return the slide 41 to its original attitude. The spiral springs 53 have their forward most ends formed into hooks 53*a* that are secured over the ends of a fixed mounting post 54, FIG. 5, that is in turn arranged across the forward end 13*b* of the housing barrel section 13. The rearmost ends of the springs 53 are also formed into hooks 53*b* that are in turn attached to the ends of the node pin 48*a*, stretching the springs 53 to extend below the rear and forward guide rollers 43 and 46. Spiral springs 53 are stretched or loaded by rearward longitudinal movement of slide 41, which stored energy is expended to return the slide 41 to its original attitude when the operator releases his thumb and index finger from engagement with the slide finger 42. Slide 41 is thereby returned by spring 53 such that the follower arm hook 51 within a label hole 16*a* will pull the linked labels 16 therewith. The roll of labels 15 is thereby unrolled with a label that was printed, as will be described, during the passage of the slide 41 towards the stationary finger 52, urged from the label dispensing opening 38, as has been described.

Movement of the slide 41 such that a roller 55 of the printer roller group 35, travels over one of the serially linked labels 16, pressing the raised indicia 19*a* from the master plate 19 into a label undersurface, thereby transferring or printing the indicia thereon. The roller 55, shown best in FIG. 5, is journaled to an axle 56 that extends across the forward most slide end 41*b* between opposite and parallel extensions 57*a* of the sides 57*b* of a U-shaped bracket 57, which sides 57*b* are turned at right angles to a bracket web 57*c*, and have the axle 47 journaled therethrough. Axle 47, as has been mentioned, additional to being journaled between the bracket sides 57*b*, is journaled through the forward most end 41*b* of the slide 41, and has the forward guide rollers 46 journaled on the ends thereof. Bracket 57 is thereby arranged to pivot around axle 47 such that the web surface 57*c* between the bracket ends 57*d* contacts a forward most slide face 41*c*, shown by dotted lines in FIG. 5, formed on the slide 41. Contact between the bracket web 57*c* and the slide face 41*c* provides a limit to the forward rotation of the roller 55 as the slide 41 is moved rearwardly towards the stationary finger 52. A torsion spring 58, shown in dotted lines in FIGS. 4 and 5, is secured around the axle 47, and is contained within a slot 59 formed in the slide forward end 41*b*. Spring 58 is arranged such that the spring legs 58*a* and 58*b* thereof individually engage the inner surface of the bracket web 57*c* and the end of the slot 59, providing biasing force that urges the bracket 57 to pivot the roller 55 journaled thereto toward the forward end 13*b* of the barrel section housing 13. The torsion spring 58 is arranged such that the legs 58*a* and 58*b* thereof are somewhat compressed towards one another, tending to bias the bracket web 57*c* into engagement with the forward face 41*c* of the slide 41. Movement of the roller 55, as has been described, from the forward end 13*b* of the housing barrel section 13 towards the rearmost end 13*a* thereof, urged by the biasing of the torsion spring 58, pivots, as shown in the dotted line representation in FIG. 5, the bracket web 57*c* into binding engagement with the slide face 41*c*. Engagement of the bracket 57, insuring that the roller 55 will apply a firm and constant pressure against one of the serially linked labels 16 over which the roller travels during slide 41 movement.

When the slide 41, biased by the spiral springs 53, returns to its starting attitude after the operator has ceased manually moving slide finger 42 toward finger 52, the torsion spring 58 is recompressed by travel of the roller 55 and slide 41 back towards the housing barrel section forward end 13*b*. Movement of slide 41 into proximity with the housing barrel section forward end 13*b* brings the forward edge of the bracket sides 57*b* into contact with the side of axle 54; which bracket to axle contact cams the roller 55 up and away from the serially linked labels 16, compressing the legs 58*a* and 58*b* of the torsion spring 58 towards one another. Roller 55 remains in this attitude, with the bracket 57*b* sides in contact with the axle 54, until the slide 41 is again displaced rearwardly, whereupon the torsion spring 58 biases the bracket downwardly such that the roller 55 journaled thereon will contact the label surface therebelow.

The housing 11, described herein is the preferred form for the housing for the label printer 10, is shown as having a pistol shape. While such a shape is preferable as it facilitates an operator gripping the butt end portion thereof with one hand as he manually operates the printer with the other hand, obviously other housing shapes could be used. Also, manually operable means other than those described herein could be substituted for the fixed and movable fingers of the preferred embodiment; which substitution would not depart from the subject matter of the present invention. Additionally, while spring biasing the slide 41 back to its starting attitude after the operator releases the slide finger 42 is preferred, such a spring biasing could be dispensed with, and the slide could be arranged to be manually displaced in both directions of travel.

Although not shown, the label printer described could be modified by appropriately forming a slot along one side of the housing barrel section 13, such that the end of a hospital requisition form, report form, a statement, or the like, could be inserted therein. Such a document end would, along with a label 16, thereby be sandwiched between the master plate 19 and the roller 55 such that movement of the slide 41 would cause the roller 55 to press the master plate indicia 19*a* into both the individual label backing and the back of the inserted document end so as to simultaneously print the indicia 19*a* into both the label and the document as described.

A window 64 is shown in FIG. 1 arranged across the right hand wall 20*a* of the housing butt end portion 12, through which window an operator can observe the roll of labels 15, therein determing approximately the number of labels remaining in the label printer 10.

As shown best in FIGS. 6–8, the label printer 10 may also be provided with a means for automatically printing sequential numbers or other such information on the labels as they are dispensed.

For this purpose dies 70 are arranged peripherally on a drum 71 that is rotatably mounted on an axis 72 that is carried by and beneath the barrel section 13. The dies are thus rotatable through an opening provided therefore in the barrel section to be beneath the labels and adjacent to the master plate when the plate is inserted. Thus, as the printer is operated to move roller 55 over the labels, the roller will cause the indicia on the dies 70 beneath the label to be pressed against the pressure sensitive label.

The dies 70 are rotated by a wheel 73 that is rotatable about an axis 74, also carried by and beneath barrel section 13. The wheel 73 is notched to engage the dies and is held against undersired rotation by a leaf spring member 75 that engages a sleeve 76 fixed to the wheel 73. A link 77 is pivotally connected at 78 to the barrel section and is engaged by the finger 51 during movement of slide 41. As the slide is moved towards the butt end 12 the link 77 is engaged by finger 51 and is pivoted about the pivot 78 in a counterclockwise direction as viewed in FIG. 6 to rotate wheel 73. During this movement the lower link member 77*b* is held against pivoting with respect to upper link member 77*a* about their connecting pivot 77*c* by a rigid backing member 79 that is fixed to the upper link member and that projects down alongside the lower link member until the finger 51 passes over the upper end of the link. As the slide returns to its starting position finger 58 again engages the upper end of the link and pivots the link clockwise (as viewed in FIG. 6) about the pivot 78. The lower link member 77*b* is allowed to pivot with respect to the upper link member 77*a* until finger 51 passes back over upper link 77*a* and the lower link member 77*b* passes over a cam surface of the cam member 76 and drops into position ready to rotate the cam member during the next rearward travel of finger 51.

A plunger 80, inserted through the housing portion surrounding the link 78 and normally biased out by spring 81 to the extent permitted by stop 82 thereon can be pushed to allow the link members to pivot such that the dies 70 can be manually rotated for setting purposes.

Also, as shown best in FIGS. 6–8, the label magazine section may be formed as a removable cassette 90. In this case the barrel section of the housing is formed with downwardly extending, surrounding skirt members 91, with the side skirt members having slots 92 therein to receive the resilient clips 93 formed in the sides of the cassette housing 94. The labels are rolled within the cassette and are directed up the rearmost portion thereof and are guided by parallel guide slots 95 that are aligned with the guide slots 36 when the cassette is snapped into position and the clips 93 are engaged in slots 92. The cassette is removed simply by squeezing the clips 93 together to release them from the slots 92 and to allow the cassette to fall free.

Although a preferred form of our invention has been herein disclosed, it is to be understood that the present disclosure is made by way of example, and the variations are possible without departing from the subject matter coming within the scope of the following claims, which subject matter we regard as our invention.

We claim:

1. Apparatus for preparing printed labels comprising a portable lable printer having a housing capable of being held in one hand by a user;

a label magazine with a cavity therein, said cavity being arranged to receive and maintain a plurality of serially linked, pressure sensitive labels;

a pair of openings into said housing;

means for guiding a flat master plate into the housing through one said opening;

a flat master plate having raised indicia projecting from one face thereof, said master plate being removably positioned by the guide means in the one said opening;

means for sequentially moving said labels into position overlying the raised indicia and out of the housing through the other of said openings, said means including a hole between each serially linked label;

a follower arm having one end pivotally connected to a support means, a hook on the other end of the follower arm, said hook being aligned with the holes between labels and having a cam surface on the end of the hook most remote from the pivot connection of the arm;

means biasing the hook of the follower arm against the labels; and means for rolling over each said label to press it against the master plate, whereby the indicia acts on the pressure sensitive label to reproduce the indicia on the label said means including a roller carried by the support means for the follower arm;

means biasing said roller to a position adjacent to the openings;

means for guiding said roller away from said openings to roll over each label after the label is positioned to overlie the raised indicia; and means for moving said roller over each label as the label is positioned to overlie said raised indicia and for pressing said label against the flat master plate, in opposition to said means biasing said roller.

2. Apparatus as in claim 1, wherein the housing is of generally pistol shape, with the magazine forming a handle and with a barrel projecting from the handle; and wherein a supply of the serially linked labels is provided in the handle and is distributed through the barrel;

the roller is within the barrel; and the openings are formed through the end of the barrel opposite to the handle.

3. Apparatus as in claim 2, further including parallel guide tracks within the barrel;

a slide extending between said guide tracks and forming the support means for the roller and the follower arm; and a finger projection extending from the slide through the housing as a means for moving the slide within the housing.

4. Apparatus as in claim 1, wherein the label magazine comprises a cassette housing releasably connected to the barrel.

5. Apparatus as in claim 1, wherein the label magazine is formed integral with the barrel and forms a gripping handle with an access door thereinto.

6. Apparatus as in claim 1, further including a plurality of dies;

means for sequentially rotating said dies to a printing position beneath a label and adjacent to the flat master plate when said plate is fully inserted in said one opening, whereby the roller is rolled over the die in a printing position as it is rolled over the master plate.

7. A cassette for use with a portable label printer having a barrel with parallel guide tracks within the barrel at opposite sides thereof and means including a hook between the guide tracks for advancing serially interconnected labels through the barrel, said cassette comprising a housing with a cavity therein, said cavity being arranged to receive a roll of labels serially arranged on a continuous backing strip;

means on the housing for releasably attaching said housing to the barrel;

guide means on the housing through which the labels are adapted to be guided, said guide means on the housing including spaced apart parallel guide tracks aligned with the guide tracks on the barrel when said cassette is releasably attached to the barrel; and a roll of labels serially arranged on a continuous backing strip in the cavity, said continuous backing strip having the edges thereof within the guide tracks of the guide means, the labels arranged between said guide tracks and holes between the labels to be engaged by the hook of the means for advancing labels through the barrel.

* * * * *